US010119206B2

(12) United States Patent
Ohara

(10) Patent No.: US 10,119,206 B2
(45) Date of Patent: Nov. 6, 2018

(54) SPEAKER DIAPHRAGM FABRIC AND MANUFACTURING METHOD THEREOF

(71) Applicant: Hiroshi Ohara, Taoyuan (TW)

(72) Inventor: Hiroshi Ohara, Taoyuan (TW)

( * ) Notice: Subject to any disclaimer, the term of this patent is extended or adjusted under 35 U.S.C. 154(b) by 621 days.

(21) Appl. No.: 14/817,262

(22) Filed: Aug. 4, 2015

(65) Prior Publication Data

US 2017/0037547 A1 Feb. 9, 2017

(51) Int. Cl.

| | |
|---|---|
| ***D03D 15/00*** | (2006.01) |
| ***H04R 7/02*** | (2006.01) |
| ***D03D 1/00*** | (2006.01) |
| ***H04R 31/00*** | (2006.01) |

(52) U.S. Cl.

CPC ..... *D03D 15/0094* (2013.01); *D03D 1/0088* (2013.01); *D03D 15/00* (2013.01); *H04R 31/003* (2013.01); *D10B 2201/01* (2013.01); *D10B 2201/02* (2013.01); *D10B 2331/021* (2013.01); *D10B 2505/00* (2013.01); *H04R 2307/029* (2013.01)

(58) Field of Classification Search

None

See application file for complete search history.

(56) References Cited

U.S. PATENT DOCUMENTS 4,320,160 A * 3/1982 Nishimura ..... B29C 70/202 139/420 R

* cited by examiner

*Primary Examiner* — Shawn Mckinnon

(74) *Attorney, Agent, or Firm* — Lin & Associates Intellectual Property, Inc.

(57) ABSTRACT

A method of manufacturing a speaker diaphragm fabric for a loudspeaker, includes: a preparation step, a plurality of first warps, at least one second warp and a plurality of wefts are prepared, wherein the second warp has characteristics different from the first warps; and a weaving step: the plurality of the first warps and the second warps are aligned and the wefts transversely cross and pass alternately over and under each of the first warps and the second warps in order to form the speaker diaphragm fabric having at least one formation region and a non-formation region exterior to the formation region. The second warps made from an inferior material are provided at the non-formation region, thereby reducing the waste cost and facilitating the differentiation of the formation region and the non-formation region.

6 Claims, 3 Drawing Sheets

SPEAKER DIAPHRAGM FABRIC AND MANUFACTURING METHOD THEREOF

BACKGROUND OF THE INVENTION

1. Field of the Invention

The present invention relates to a speaker diaphragm fabric and the manufacturing method thereof.

2. The Prior Arts

A piece of speaker diaphragm fabric is formed by interlacing or weaving a plurality of wefts with a plurality of warps, the assembly thereof undergoes a resinous immersion process, a drying process, a formation process and a cutting-off process. The purpose of immersing the speaker diaphragm in the resinous solution is to enhance the tenacity of the speaker diaphragm fabric while the drying process is to eliminate the moisture of the resinous solution in the speaker diaphragm fabric. The formation process is to provide one or more rows of speaker diaphragm formation regions along the length of the fabric. The cutting-off process is to cut off a desired dimension of speaker diaphragms from the fabric. In conventional manufacturing methods, after cutting-off the desired speaker diaphragms, the remaining fabrics are discarded as waste.

Yet some of the warps and wefts woven into the speaker diaphragm fabric are made from highly expensive materials, such as silk or MPIA (Poly-Metaphenylene Isophthalamides); the more remaining fabric becomes waste, the higher the cost for the manufacturer.

Moreover, in a conventional speaker diaphragm fabric, since all the warps have the same characteristics in material, color, and dimension, it is difficult for the manufacturers to differentiate the formation regions of speaker diaphragms from different rows and often results in cutting mistakes.

Under certain circumstances, a conventional speaker diaphragm fabric may have two or more distinct sets of formation regions, which are different in dimensions, in a row. It is difficult to differentiate the formation regions in different dimensions when having warps in the same characteristics in material, color and dimension.

Therefore, providing a speaker diaphragm and the manufacturing method thereof which allows easy recognition of different rows of formation regions or different dimensions of formation regions in a row as well as reduces waste cost are the vital targets in the art.

SUMMARY OF THE INVENTION

A primary objective of the present invention is to provide a speaker diaphragm fabric and the manufacturing method thereof, wherein second warps are provided at a region where no speaker diaphragms will be formed (non-formation region) and the second warps are made from a material with inferior quality and price comparing to a first warp, thereby economizing the material waste after the cutting-off process.

Another objective of the present invention is to provide a speaker diaphragm fabric and the manufacturing method thereof, wherein second warps are provided at the non-formation region between the first and second formation regions located in different rows. Since the first and second warps have different colors and/or dimensions, differentiating and recognizing the first and second formation regions in different rows can be conducted easily to avoid cutting mistakes.

Yet another objective of the present invention is to provide a speaker diaphragm fabric and the manufacturing method thereof, wherein second warps are provided at the non-formation region on one side of the first formation regions. Since the first and second warps have different colors and/or dimensions relative to each other, differentiating the first and second formation regions that are in different dimensions in the same row can be conducted easily to avoid cutting mistakes.

To achieve the objectives thereof, the present invention provides a method of manufacturing a speaker diaphragm fabric by the following steps.

A preparation step: preparing a plurality of first warps, at least one second warp and a plurality of wefts, wherein the second warp has at least one characteristic different from the first warp.

A weaving step: aligning the plurality of first warps and the second warps and transversely crossing each of the wefts to pass alternately over and under each of the first warps and the second warps in order to form a speaker diaphragm fabric having at least one formation region. The second warps are provided at the non-formation region exterior to the formation region.

In one preferred embodiment, the first warps are different from the second warps in materials, colors and/or dimensions.

Preferably, in the preparation step: a plurality of second warps are prepared; and in the weaving step, the plurality of second warps are provided at the non-formation region between the formation regions and two ends of the speaker diaphragm fabric in a width direction.

Preferably, in the weaving step, the speaker diaphragm fabric has a first formation region on a first row and a second formation region on a second row. The second warps are provided at the non-formation region between the first and second row of formation regions.

More preferably, during the preparation step, one distal end of the second warps is spliced with one of the first warps and during the weaving step, the piece of speaker diaphragm fabric has a first formation region and a second formation region along a first row, and the first formation region has a dimension greater than the second formation region. The second warps are provided at the non-formation region on one side of the second formation region on the first row while the first warps spliced with the second warps are provided on the first row and extending through the first formation region.

A speaker diaphragm fabric of the present invention is woven by a plurality of first warps, at least one second warp, and a plurality of wefts, with at least one formation region. Wherein, the second warps have at least one characteristic different from the first warps and are provided at the non-formation region exterior to the formation region.

In one preferred embodiment of the present invention, the first warps are different from the second warps in materials, colors and/or dimensions.

Preferably, the speaker diaphragm fabric of the present invention includes a plurality of second warps provided at the non-formation region between the formation regions and two ends of said speaker diaphragm fabric in a width direction.

Preferably, the speaker diaphragm fabric of the present invention has a first formation region on a first row and a second formation region on a second row. The second warps are provided at the non-formation region between the first and second rows.

Preferably, one distal end of the second warps is spliced with one of the first warps and during the weaving step, the piece of speaker diaphragm fabric has a first formation region and a second formation region along the first row and the first formation region has a dimension greater than the second formation region. The second warps are provided at the non-formation region on one side of the second formation region on the first row while the first warps spliced with the second warps are provided on the first row and extending through the first formation region.

The technical effect provided by the present invention reside in that the first warps made from materials with superior quality and price are provided through the formation regions while the second warps made from inferior materials are provided through the non-formation region, reducing the cost of waste. In addition, the present application allows easy recognition of different rows of formation regions or different dimensions of formation regions in a row, thereby avoiding cutting mistakes on the speaker diaphragms of the present invention.

BRIEF DESCRIPTION OF THE DRAWINGS

The present invention will be apparent to those skilled in the art by the following detailed description of preferred embodiments thereof, with reference to the attached drawings, in which.

DETAILED DESCRIPTION OF THE PREFERRED EMBODIMENTS

The drawings are included to assist further understanding to the invention, and are incorporated in and constitute a part of this specification. The drawings illustrate embodiments of the invention and, together with the description, serve to explain the principles of the invention.

Figure 1:
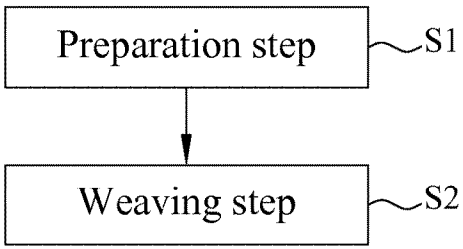
FIG. 1 is a block diagram illustrating the steps of the manufacturing method of a speaker diaphragm fabric according to the present invention.
Figure 2:
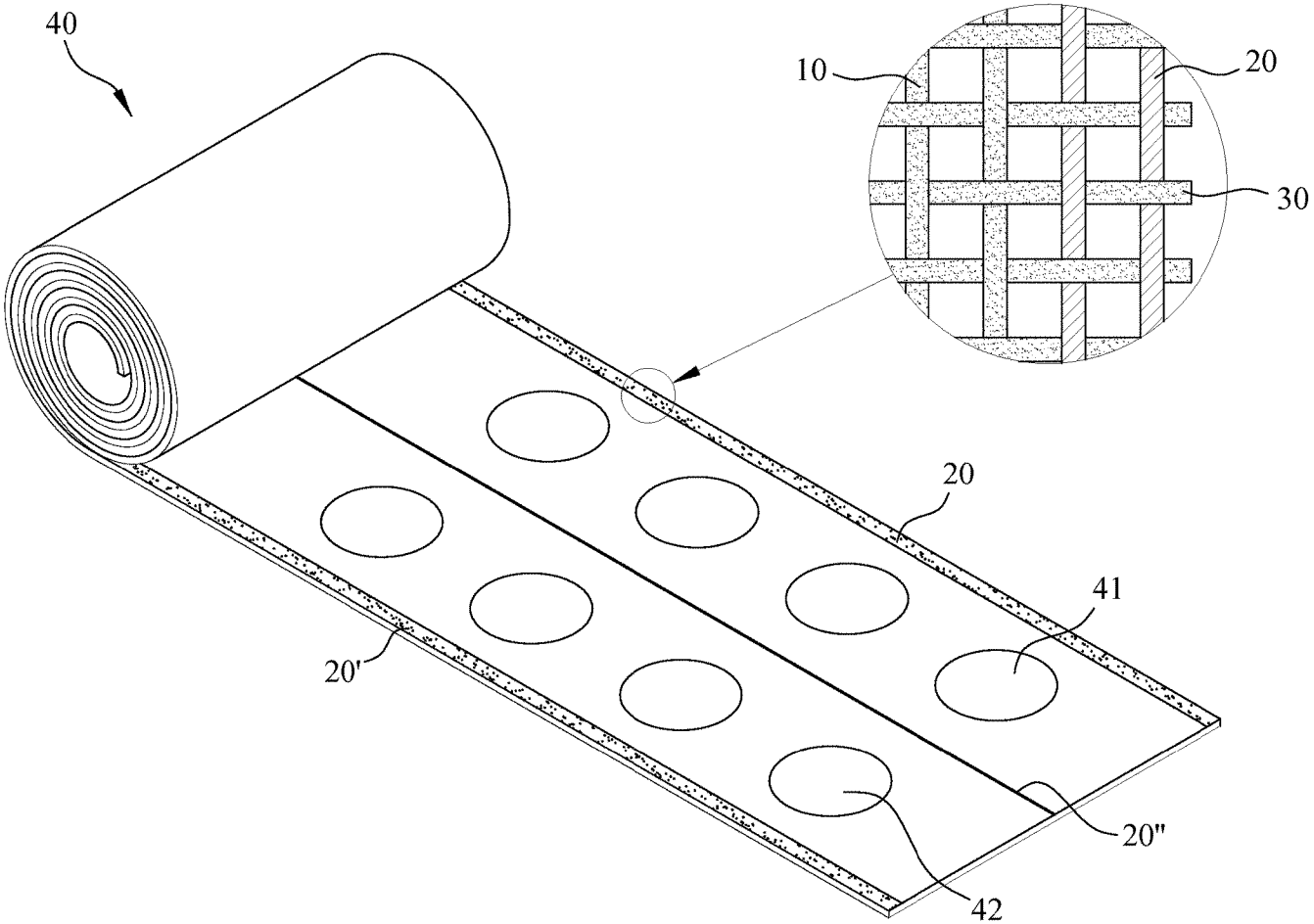
FIG. 2 shows a perspective view of the first embodiment of the speaker diaphragm fabric manufactured according to the method of the present invention.

Referring to FIGS. 1 and 2, wherein FIG. 1 is a block diagram illustrating the steps of manufacturing method of a speaker diaphragm fabric according to the present invention while FIG. 2 shows a perspective view of the first embodiment. The method of manufacturing a speaker diaphragm fabric in the first embodiment includes the following steps.

A preparation step S1, where a plurality of first warps 10, a plurality of second warps 20, 20', 20" and a plurality of wefts 30 are prepared in a manner that the second warps 20, 20', 20" have at least one characteristic different from the first warps 10. Preferably, the first warps 10 are made from a different material, have a different color and/or a different dimension with respect to the second warps 20, 20', 20".

A weaving step S2, where the plurality of first warps 10 and the plurality of second warps 20, 20', 20" are aligned, and the wefts 30 are transversely crossed to pass alternately over and under each of the first warps 10 and each of the second warps 20, 20', 20" in order to form a speaker diaphragm fabric 40 having at least one formation region. The second warps 20, 20', 20" are provided at the non-formation region exterior to the formation region, whereat no speaker diaphragm is formed. In this embodiment, the speaker diaphragm fabric 40 has a plurality of the first formation regions 41 and a plurality of the second formation regions 42, the first formation regions 41 align along the longitude of the speaker diaphragm fabric 40 on a first row, and the second formation regions 42 align in the same way on a second row. In other words, the first formation regions 41 and the second formation regions 42 are aligned separately on different rows. A first portion of the second warps 20 is provided at the non-formation region between the first formation regions 41 and one width end of the speaker diaphragm fabric 40, a second portion of the second warps 20' is provided at the non-formation region between the second formation regions 42 and the other width end of the speaker diaphragm fabric 40, and a third portion of the second warps 20" is provided at the non-formation region between the first and the second rows. Wherein, the majority of the first warps 10 extends through the first and second formation regions 41, 42, the non-formation region between the first formation regions 41, and the non-formation region between the second formation regions 42 while only a minority of the first warps 10 are provided at the same non-formation region with the second warps 20, 20', 20" at the two sides of the speaker diaphragm fabric 40 and between the first and second rows.

Once the speaker diaphragm fabric 40 is manufactured as stated above, the same is immersed in resinous solution, dried, formed and cut off to become a final speaker diaphragm which can be a damper, sound diaphragm or drum diaphragm. The remaining fabric 40 becomes waste. To be more specific, the first warps 10 are made from a material with higher price and superior quality comparing to the second warps 20, 20', 20". Preferably, expensive and high-quality materials, such as silk or MPIA (Poly-Metaphenylene Isophthalamides) are suitable for fabrication of the first warps 10 while an inexpensive and inferior material, such as cotton, is suitable for fabrication of the second warps 20, 20', 20". In addition, since the third portion of second warps 20" is provided at the non-formation region between the first and second rows, when the color thereof is different from the first warps 10, the second warps 20" can serve as an indicator to differentiate the first and second formation regions 41, 42. Certainly, the second warps 20" can also serve as an indicator by having a different dimension with the first warps 10 to facilitate differentiation of the first and second formation regions 41, 42.

Figure 3:
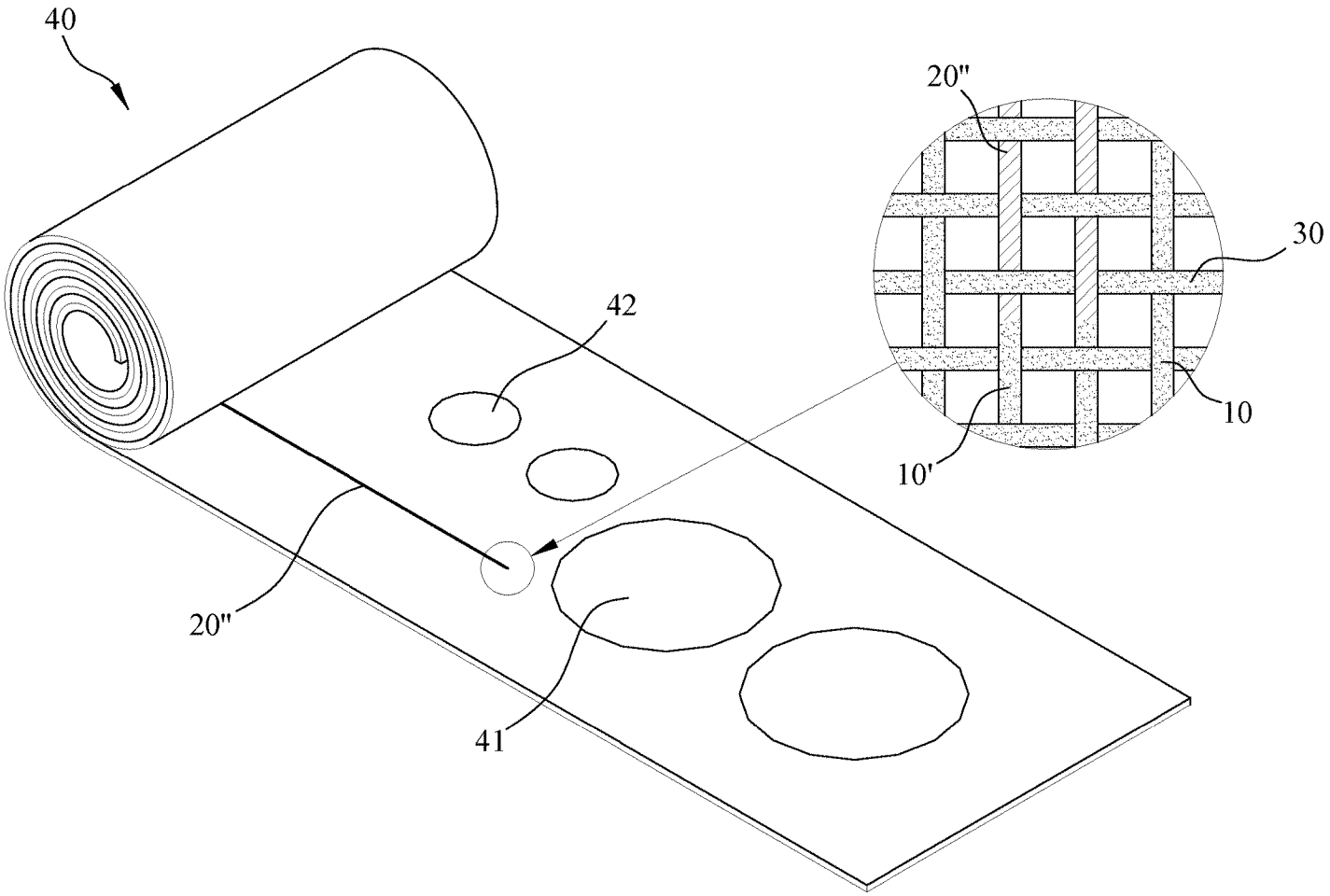
FIG. 3 shows a perspective view of the second embodiment of the speaker diaphragm fabric manufactured according to the method of the present invention.

FIG. 3 shows a perspective view of the second embodiment of the speaker diaphragm fabric manufactured according to the method of the present invention. The difference with respect to the previous embodiment resides in that in the preparation step S1, one distal end of the second warps 20" is spliced with one of the first warps 10. After the weaving step S2, the first formation regions 41 and the second formation regions 42 aligns together on a first row, and the first formation regions 41 have a dimension greater than the second formation regions 42. The second warps 20" are provided on the first row (in other words, the second warps 20" is on the same row with the first formation regions 41 and the second formation regions 42), at the non-formation region on one side of the second formation regions 42. The first warps 10 spliced with the second warps 20" are also provided on the first row and are extending through the first formation regions 41. In the same way, having a different color or dimension from the first warps, the second warps 20" can serve as the indicator to differentiate the first and second formation regions 41, 42, which differ in dimension but are formed on the same row.

Referring again to FIG. 2, the speaker diaphragm fabric 40 in the first embodiment of the present invention is woven by a plurality of first warps 10, a plurality of second warps 20, 20', 20", and a plurality of wefts 30, having at least one formation region. Wherein, the second warps 20, 20', 20" have at least one characteristic different from the first warps 10. Preferably, the second warps 20, 20', 20" are made from a different materials, have a different color and/or a different dimension with respect to the first warps 10. The second warps 20, 20', 20" are provided at the non-formation region exterior to the formation regions. In this embodiment, the speaker diaphragm fabric 40 has a plurality of first formation regions 41 and a plurality of second formation regions 42, the first formation regions 41 align along the longitude of the speaker diaphragm fabric 40 on a first row, and the second formation regions 42 align in the same way on a second row. In other words, the first formation regions 41 and the second formation regions 42 are aligned separately on different rows. A first portion of the second warps 20 is provided at the non-formation region between the first formation regions 41 and one width end of the speaker diaphragm fabric 40, a second portion of the second warps 20' is provided at the non-formation region between the second formation regions 42 and the other width end of the speaker diaphragm fabric 40, and a third portion of the second warps 20" is provided at the non-formation region between the first and second rows. The majority of the first warps 10 extends through the first and second formation regions 41, 42, the non-formation region between the first formation regions 41, and the non-formation region between the second formation regions 42 while only a minority of the first warps 10 are provided at the same non-formation region with the second warps 20, 20', 20" at the two sides of the speaker diaphragm fabric 40 and between the first and second rows.

Once the speaker diaphragm fabric 40 is manufactured, it is immersed in resinous solution, dried, formed and cut off to become a final speaker diaphragm which can be a damper, sound diaphragm or drum diaphragm, and the remaining fabric 40 becomes waste. To be more specific, the first warps 10 are made from a material with higher price and superior quality comparing to the second warps 20, 20', 20". Preferably, expensive and high-quality materials, such as silk or MPIA (Poly-Metaphenylene Isophthalamides) are suitable for fabrication of the first warps 10 while an inexpensive and inferior material, such as cotton, is suitable for fabrication of the second warps 20, 20', 20". In addition, since the third portion of second warps 20" is provided at the non-formation region between the first and second rows, when the color thereof is different from the first warps 10, the second warps 20" can serve as an indicator to differentiate the first and second formation regions 41, 42. Certainly, the second warps 20" can also serve as an indicator by having a different dimension with the first warps 10 to facilitate differentiation of the first and second formation regions 41, 42.

FIG. 3 shows a perspective view of the second embodiment of the speaker diaphragm fabric manufactured according to the method of the present invention. The difference with respect to the previous embodiment resides in that, one distal end of every second warp 20" is spliced with one of the first warps 10. The first formation regions 41 and the second formation regions 42 aligns together on a first row, and the first formation regions 41 have a dimension greater than the second formation regions 42. The second warps 20" are provided on the first row (in other words, the second warps 20" is on the same row with the first formation regions 41 and the second formation regions 42), at the non-formation region on one side of the second formation regions 42. The first warps 10 spliced with the second warps 20" are also provided on the first row and are extending through the first formation regions 41. In the same way, having a different color or dimension from the first warps, the second warps 20" may serve as the indicator to differentiate the first and second formation regions 41, 42, which differ in dimension but are provided on the same row.

In the weaving steps S2, the present invention provides the first warps 10, which are made from a high-quality and expensive material, through the first and second formation regions 41, 42 while the second warps 20, 20', 20" made from an inexpensive and inferior material are provided through the non-formation region located between the first formation regions 41 and a width end of the speaker diaphragm 40, the second formation regions 42 and another width end of the speaker diaphragm 40, and between the different rows of the first and second formation regions 41, 42. Hence, after cutting off the speaker diaphragms from the speaker diaphragm fabric 40 manufactured according to the method in present invention, the waste from the speaker diaphragm fabric 40 remains fewer first warps 10 made from high-quality and expensive material than the conventional speaker diaphragm fabric, thereby economizing the manufacturing cost and reducing waste.

In addition, providing the second warps 20" in a different color and/or dimension from the first warps 10, at the non-formation region between the rows of first and second formation regions 41, 42 allows manufacturers to easily differentiate the first and second formation regions 41, 42 in different rows to prevent cutting mistakes in the cutting-off process. Especially when the second warps 20" have a brighter color or greater dimension than the first warps 10, differentiation is highly effective. Differentiation is the most effective if the second warps 20" have a brighter color and a greater dimension than the first warps 10.

It is to note that the distal ends of the second warp 20" can be spliced with the first warps 10. The second warps 20" are provide at the non-formation region on one side of the second formation regions 42 in the same row, but do not extend through the first formation regions 41. It is the first warps 10' spliced with the second warps 20" extend through the first formation regions 41. And since the second warps 20" have a color and/or dimension different from the first warps 10, the manufacturer can easily differentiate and recognize the first and second formation regions 41, 42 in the same row but with different dimensions, to prevent cutting mistakes. Especially when the second warps 20" have a brighter color or greater dimension comparing to the first warps 10, differentiation is highly effective. Differentiation is the most effective if the second warps 20" have a brighter color and a greater dimension comparing to the first warps 10.

The drawings and detailed description hereto are for understanding to the preferred embodiments of the present application, but are not intended to limit the invention to the particular form disclosed. The intention is to cover all modifications, equivalents and alternatives falling within the spirit and scope of the present invention.

What is claimed is:

1. A speaker diaphragm fabric, woven by a plurality of first warps, at least one second warp, and a plurality of wefts, having at least one formation region and at least one non-formation region exterior to said at least one formation region, wherein each of said at least one formation region has a plurality of said first warps crossing a plurality of said wefts transversely therein for forming a speaker diaphragm, said at least one non-formation region has some of said at least one second warp crossing some of said wefts transversely therein, said at least one second warp has at least one characteristic different from said first warps, and none of said at least one second warp is in any of said at least one formation region.

2. The speaker diaphragm fabric according to claim 1, wherein said first warps are different from said at least one second warp in materials, colors and/or dimensions.

3. The speaker diaphragm fabric according to claim 1, comprising a plurality of second warps, and two non-formation regions located respectively between said at least one formation region and two ends of said speaker diaphragm fabric in a width direction, and each of said two non-formation regions having a portion of said second warps crossing said wefts transversely therein.

4. The speaker diaphragm fabric according to claim 1, wherein said speaker diaphragm fabric has a first formation region and a second formation region of said at least one formation region, said first formation region is formed on a first row and said second formation region is formed on a second row, and said at least one second warp is provided at said at least one non-formation region between said first and second rows.

5. The speaker diaphragm fabric of claim 1, wherein one distal end of said at least one second warp is spliced with one of said first warps, said speaker diaphragm fabric has a first formation region and a second formation region of said at least one formation region aligned on a first row, said first formation region has a dimension greater than said second formation region, and said at least one second warp is provided at said at least one non-formation region on one side of said second formation region on said first row while the first warp spliced with said at least one second warp is provided on said first row and is extending through said first formation region.

6. A speaker diaphragm fabric, woven by a plurality of first warps, at least one second warp, and a plurality of wefts, having a first formation region and a second formation region aligned on a row, wherein said at least one second warp has at least one characteristic different from said first warps and is provided at a non-formation region exterior to said first and second formation regions, one distal end of said at least one second warp is spliced with one of said first warps, said first formation region has a dimension greater than said second formation region, and said at least one second warp is provided at said non-formation region on one side of said second formation region on said row while the first warp spliced with said at least one second warp is provided on said row and is extending through said first formation region.

* * * * *